US007893877B2

(12) United States Patent
Wang et al.

(10) Patent No.: US 7,893,877 B2
(45) Date of Patent: Feb. 22, 2011

(54) ANTENNA FOR WWAN AND INTEGRATED ANTENNA FOR WWAN, GPS AND WLAN

(75) Inventors: Chi-Yueh Wang, Kaohsiung (TW); Cheng-Han Lee, Kaohsiung (TW); Ching-Chia Mai, Kaohsiung (TW)

(73) Assignee: Yageo Corporation, Kaohsiung (TW)

( * ) Notice: Subject to any disclaimer, the term of this patent is extended or adjusted under 35 U.S.C. 154(b) by 1146 days.

(21) Appl. No.: 11/589,236

(22) Filed: Oct. 30, 2006

(65) Prior Publication Data

US 2007/0096999 A1 May 3, 2007

(30) Foreign Application Priority Data

Oct. 31, 2005 (TW) ..... 94138184 A

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 6,339,400 B1 1/2002 Flint et al.
6,686,886 B2 * 2/2004 Flint et al. ..... 343/702
7,084,814 B2 * 8/2006 Chen et al. ..... 343/700 MS
7,242,353 B2 * 7/2007 Hung et al. ..... 343/702
7,289,071 B2 * 10/2007 Hung et al. ..... 343/702
7,535,422 B2 * 5/2009 Liu et al. ..... 343/702

* cited by examiner

*Primary Examiner*—Tan Ho
(74) *Attorney, Agent, or Firm*—Volentine & Whitt, P.L.L.C.

(57) ABSTRACT

An integrated antenna for WWAN, GPS, and WLAN includes a ground metal plane, a WWAN antenna, and a WLAN antenna. The WWAN antenna is connected to the ground metal plane and includes first and second radiating metal strips which induce a first resonance mode and a second resonance mode respectively. The WLAN antenna is connected to the ground metal plane and includes third and fourth radiating metal strips which induce a third resonance mode and a fourth resonance mode respectively. The integrated antenna can be used in WWAN and WLAN at the same time. The ground metal plane of the integrated antenna does not need to connect to a ground end of a wireless electronic device, and is used for grounding. Therefore, the integrated antenna can be mounted on any part of a wireless electronic device, and can have stable electrical characteristics.

32 Claims, 14 Drawing Sheets

ANTENNA FOR WWAN AND INTEGRATED ANTENNA FOR WWAN, GPS AND WLAN

BACKGROUND OF THE INVENTION

1. Field of the Invention

The present invention relates to an antenna for wireless network, and more particularly to an antenna for WWAN and an integrated antenna for WWAN and WLAN.

2. Description of the Prior Art

Along with the rapid progress of wireless communication technology, various multi-frequency communication products emerge competitively one after another. Thus, wireless communication products have gradually become one part of daily life. Almost all the new products have been provided with the wireless transmission function to satisfy people's requirements. Notebook computers often require data transmission, and wireless transmission has the advantage of eliminating troubles in wiring and setting. Therefore, the arrangement of an antenna is required in order to achieve wireless transmission. However, the wide acceptance of notebook computers with wireless transmission relies heavily on their appearance, size, and performance. Accordingly, a favorable antenna design and the suitable placement of the antenna are especially important.

A conventional antenna arrangement for notebook computers, for example, is disclosed in U.S. Pat. No. 6,339,400B1, in which one or more antennae 11, 12 are disposed around a screen 10 of a notebook computer 1, as shown in FIG. 1. However, as the ground ends of the antennae 11, 12 must be connected to that of the screen or the frame of the screen, the conventional antenna arrangement design has a limitation in the installation site, i.e., the installation site cannot be freely adjusted. Moreover, the antennae 11, 12 can only be applicable to the frequencies of WLAN or the frequencies of WWAN, and cannot be used for the frequencies of WLAN and WWAN at the same time.

Therefore, it is necessary to provide an integrated antenna that can be simultaneously used in WWAN and WLAN at the same time, in order to solve the above problems.

SUMMARY OF THE INVENTION

The present invention is directed to provide an integrated antenna for WWAN and WLAN. The integrated antenna comprises a ground metal plane, a WWAN antenna, and a WLAN antenna. The WWAN antenna is connected to the ground metal plane and comprises a first radiating metal strip and a second radiating metal strip. The first and second radiating metal strips are used to induce a first resonance mode and a second resonance mode respectively. The WLAN antenna is connected to the ground metal plane and comprises a third radiating metal strip and a fourth radiating metal strip. The third and fourth radiating metal strips are used to induce a third resonance mode and a fourth resonance mode respectively.

The integrated antenna of the present invention is disposed inside a wireless electronic device. The ground metal plane of the integrated antenna can independently provide a grounding effect, and can be selectively connected to a ground end of the wireless electronic device or not. Therefore, the integrated antenna can be mounted on any part of the wireless electronic device, and also have stable electrical characteristics.

The integrated antenna of the present invention has the functions of both WWAN and WLAN, and can be used in WWAN and WLAN at the same time. The integrated antenna of the present invention further has an auxiliary ground metal plane that can be bent and folded, thus saving space to satisfy the requirements of customers and provide the preferred grounding effect and radiation effect.

DETAILED DESCRIPTION OF THE INVENTION

Figure 1:
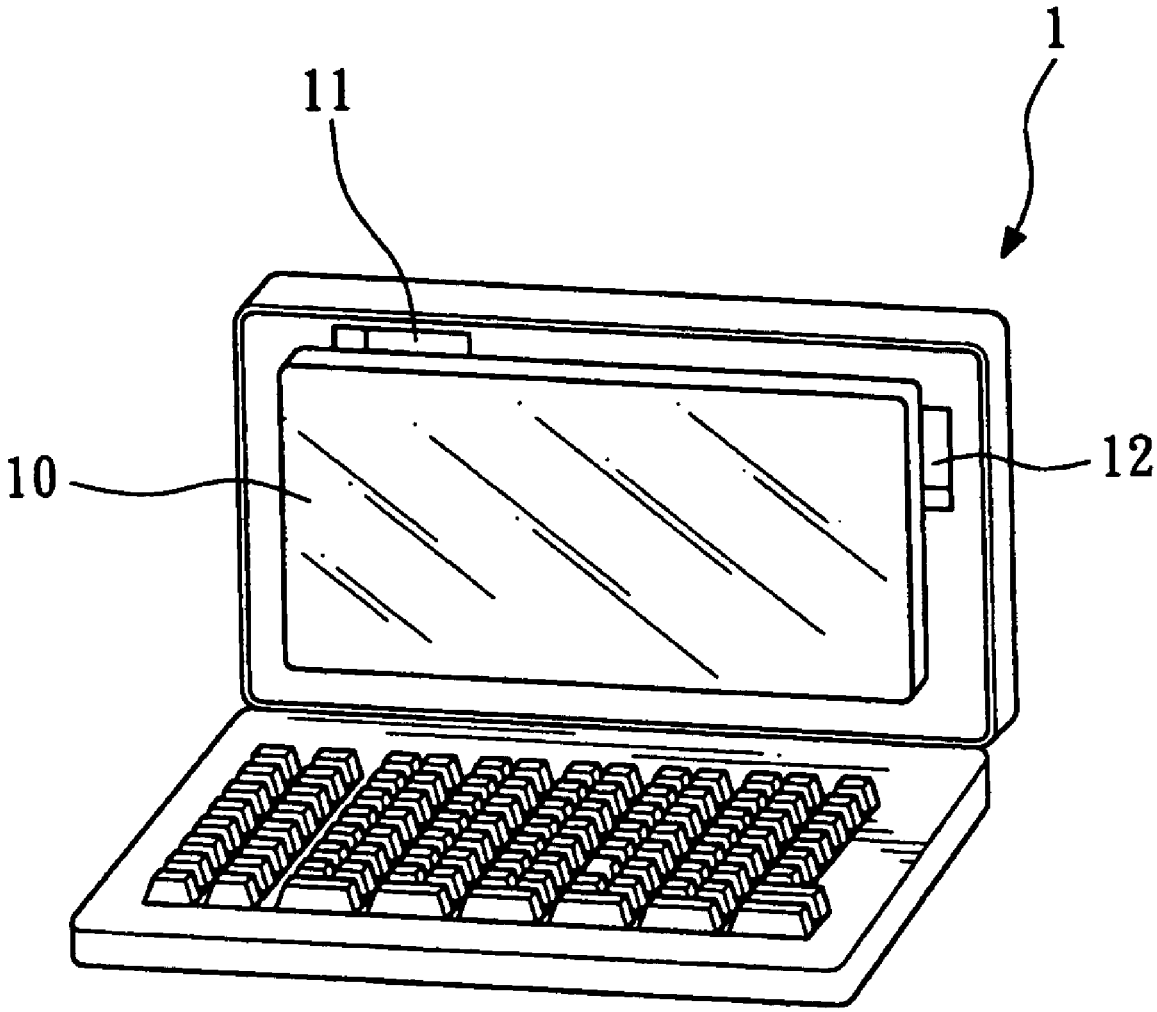
FIG. 1 is a schematic view of the conventional antennae disposed around the screen of a notebook computer.
Figure 2A:
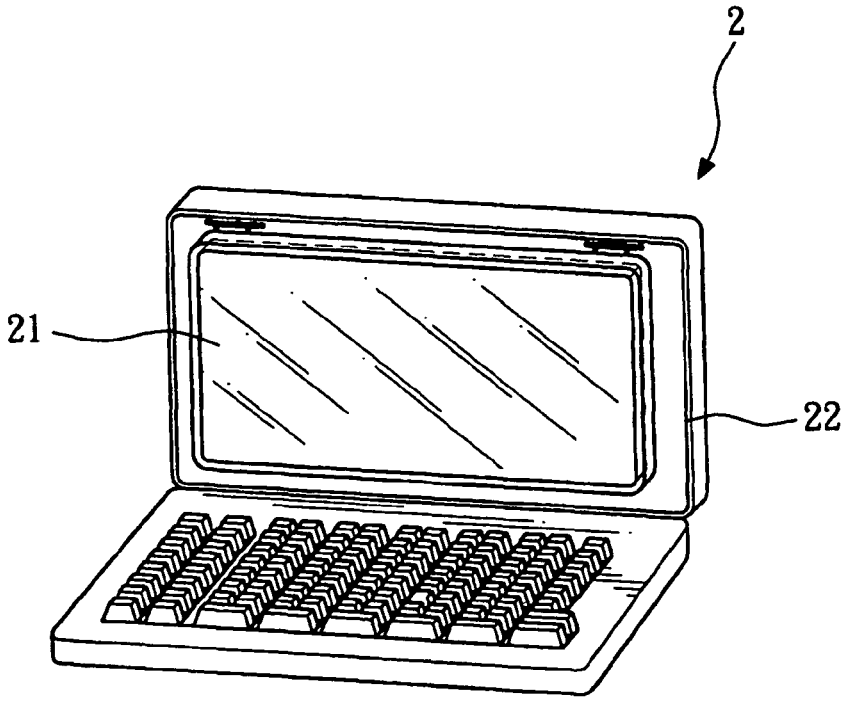
FIG. 2A is a schematic view of the antenna disposed in the screen frame of a notebook computer according to the present invention.
Figure 2B:
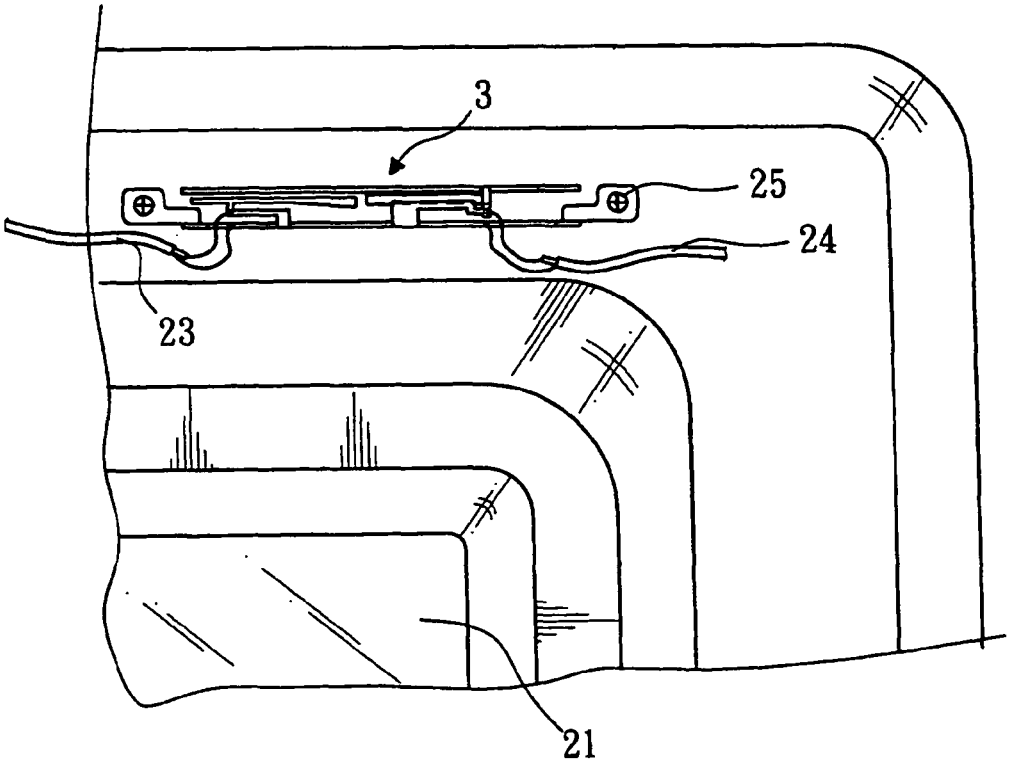
FIG. 2B is a schematic partially enlarged view of the antenna provided disposed in the screen frame of a notebook computer.

FIGS. 2A and 2B show the arrangement structure of the integrated antenna as the present invention is applied to a notebook computer 2. The present invention is applicable to various wireless electronic devices including, but not limited to, notebook computers. The integrated antenna of the present invention can be used in common electronic products such as personal digital assistants (PDAs) to achieve wireless communication. The notebook computer 2 has a screen 21 and a screen frame 22. An integrated antenna 3 of the present invention is disposed in the screen frame 22 of the notebook computer 2. Two coaxial wires 23 and 24 are used to connect the integrated antenna 3 to a control circuit of the notebook computer 2, so as to perform data transmission with the integrated antenna 3.

The integrated antenna 3 is provided with at least one fixing portion for fixing the integrated antenna 3 to the screen frame 22. In this embodiment, the fixing portion is two through holes 39 (referring to FIG. 3) used for two screws 25 to fix the integrated antenna 3 to the screen frame 22 of the notebook computer 2 (as shown in FIG. 2B).

Figure 3:
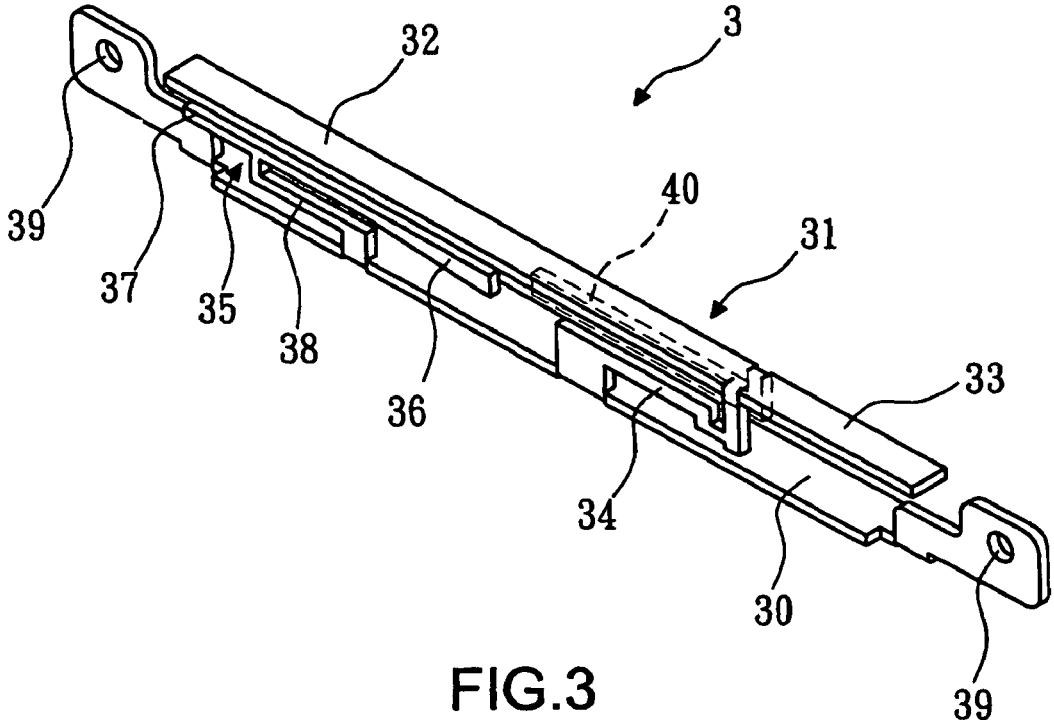
FIG. 3 is a stereogram view of the integrated antenna according to the first embodiment of the present invention.
Figure 4:
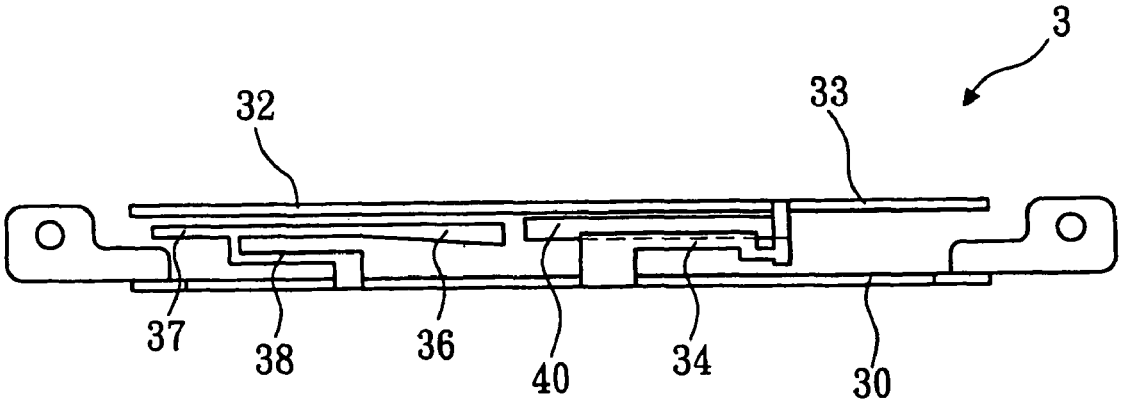
FIG. 4 is a front view of the integrated antenna according to the first embodiment of the present invention.

FIGS. 3 and 4 are schematic views of the integrated antenna 3 applied to WWAN and WLAN according to the first embodiment of the present invention. The integrated antenna 3 includes a ground metal plane 30, a WWAN antenna 31, and a WLAN antenna 35. The WWAN antenna 31 is connected to the ground metal plane 30 and includes a first radiating metal strip 32 and a second radiating metal strip 33. The first and second radiating metal strips 32, 33 are used to induce a first resonance mode and a second resonance mode respectively.

The first radiating metal strip 32 is longer than the second radiating metal strip 33, and thus the frequency of the second resonance mode is higher than that of the first resonance mode. The frequency of the first resonance mode is 850 MHz and 900 MHz, and the frequency of the second resonance mode is 1575 MHz, 1800 MHz and 1900 MHz, or 1800 MHz, 1900 MHz and 2000 MHz, wherein 1575 MHz is suitable for GPS.

The WWAN antenna 31 further includes a first connecting metal strip 34 for connecting the first radiating metal strip 32 and the second radiating metal strip 33 to the ground metal plane 30. The first radiating metal strip 32 and the second radiating metal strip 33 extend in two opposite directions substantially parallel to the ground metal plane 30 and are spaced at a distance. Thus, the WWAN antenna 31 assumes a T-shape.

The WLAN antenna 35 is connected to the ground metal plane 30 and includes a third radiating metal strip 36 and a fourth radiating metal strip 37. The third and fourth radiating metal strips 36, 37 are used to induce a third resonance mode and a fourth resonance mode respectively. The third radiating metal strip 36 is longer than the fourth radiating metal strip 37, and thus the frequency of the fourth resonance mode is higher than that of the third resonance mode. The frequency of the third resonance mode is 2.4 GHz, and the frequency of the fourth resonance mode is 5 GHz.

The WLAN antenna 35 further includes a second connecting metal strip 38 for connecting the third radiating metal strip 36 and the fourth radiating metal strip 37 to the ground metal plane 30. The third radiating metal strip 36 and the fourth radiating metal strip 37 extend in two opposite directions, substantially parallel to the ground metal plane 30 and are spaced at a distance. Thus, the WLAN antenna 35 assumes a T-shape.

Therefore, the integrated antenna 3 of the present invention can be applied to frequencies of WWAN (for example, 850 MHz, 900 MHz, 1575 MHz, 1800 MHz and 1900 MHz, or 850 MHz, 900 MHz, 1800 MHz, 1900 MHz and 2000 MHz) and frequencies of WLAN (2.4 GHz or 5 GHz) at the same time.

Figure 18:
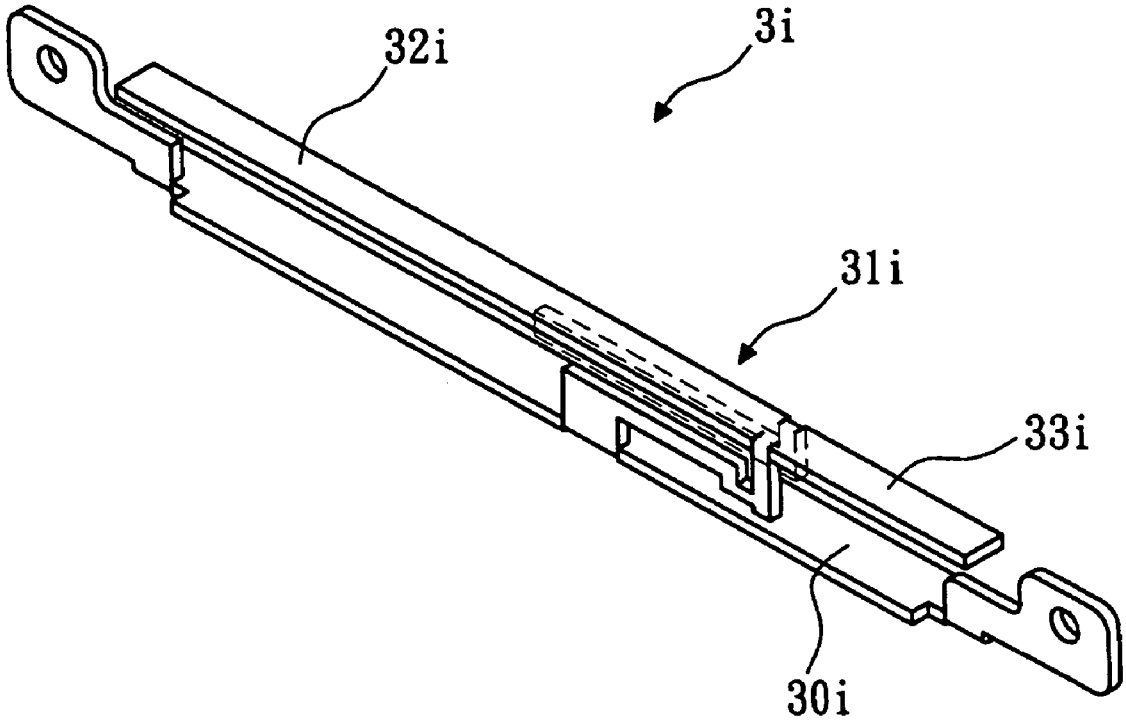
FIG. 18 is a stereogram view of the antenna for WWAN according to the present invention.

The integrated antenna 3 for WWAN and WLAN in the first embodiment of the present invention can only be used in WWAN by deleting the WLAN antenna, thus becoming an antenna 3*i* for WWAN, as shown in FIG. 18. The antenna 3*i* for WWAN comprises: a ground metal plane 30*i*; and a WWAN antenna 31*i*. The WWAN antenna 31*i* is connected to the ground metal plane 30*i*. The WWAN antenna 31*i* comprises a first radiating metal strip 32*i* and a second radiating metal strip 33*i*. The first and second radiating metal strips 32*i* and 33*i* are used to induce a first resonance mode and a second resonance mode respectively. The WWAN antenna 31*i* have the same structure and arrangement as the above-mentioned ground metal plate 30 and the WWAN antenna 31 of the integrated antenna 3 in the first embodiment of FIG. 3, and the details will not be described herein again.

Figure 5:
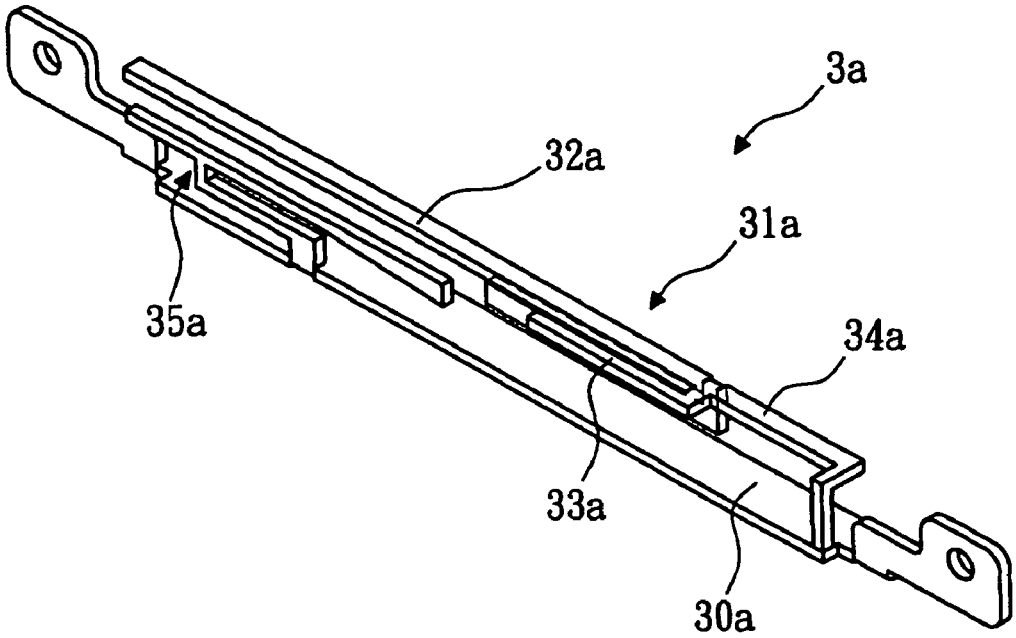
FIG. 5 is a stereogram view of the integrated antenna according to the second embodiment of the present invention.
Figure 6:
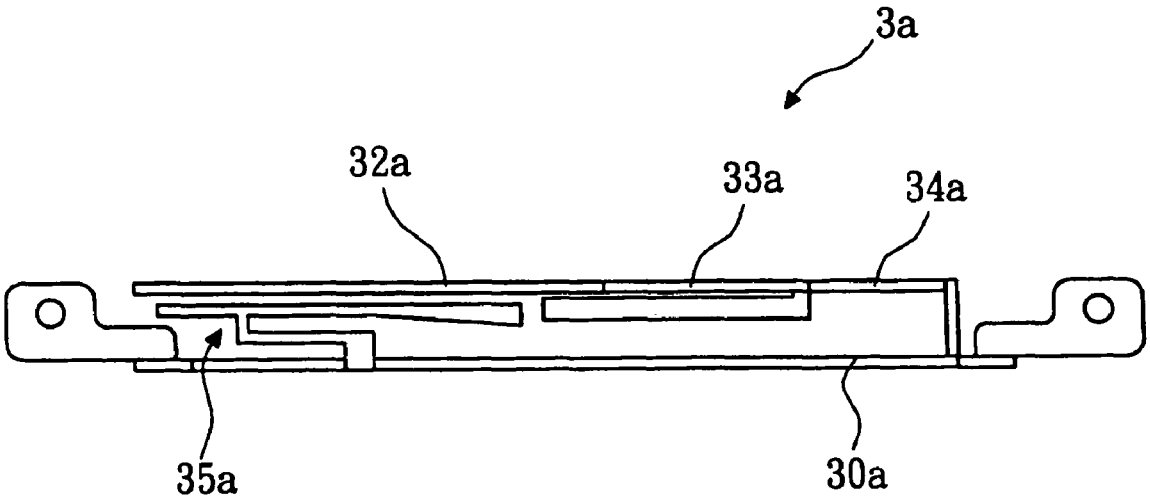
FIG. 6 is a front view of the integrated antenna according to the second embodiment of the present invention.

FIGS. 5 and 6 are schematic views of an integrated antenna 3*a* applied to WWAN and WLAN according to a second embodiment of the present invention. The integrated antenna 3*a* includes a ground metal plane 30*a*, a WWAN antenna 31*a*, and a WLAN antenna 35*a*. Unlike the integrated antenna 3 of the first embodiment, the WWAN antenna 31*a* of the second embodiment is not T-shaped. The first connecting metal strip 34*a* of the WWAN antenna 31*a* connects the first radiating metal strip 32*a* and the second radiating metal strip 33*a* to the ground metal plane 30*a*. The first radiating metal strip 32*a* and the second radiating metal strip 33*a* extend in the same direction substantially parallel to the ground metal plane 30*a* and are spaced at a distance. Thus, the WWAN antenna 31*a* assumes an F-shape. The integrated antenna 3*a* for WWAN and WLAN in the second embodiment of the present invention can only be used in WWAN by deleting the WLAN antenna 35*a*, thus becoming an antenna for WWAN.

Figure 7:
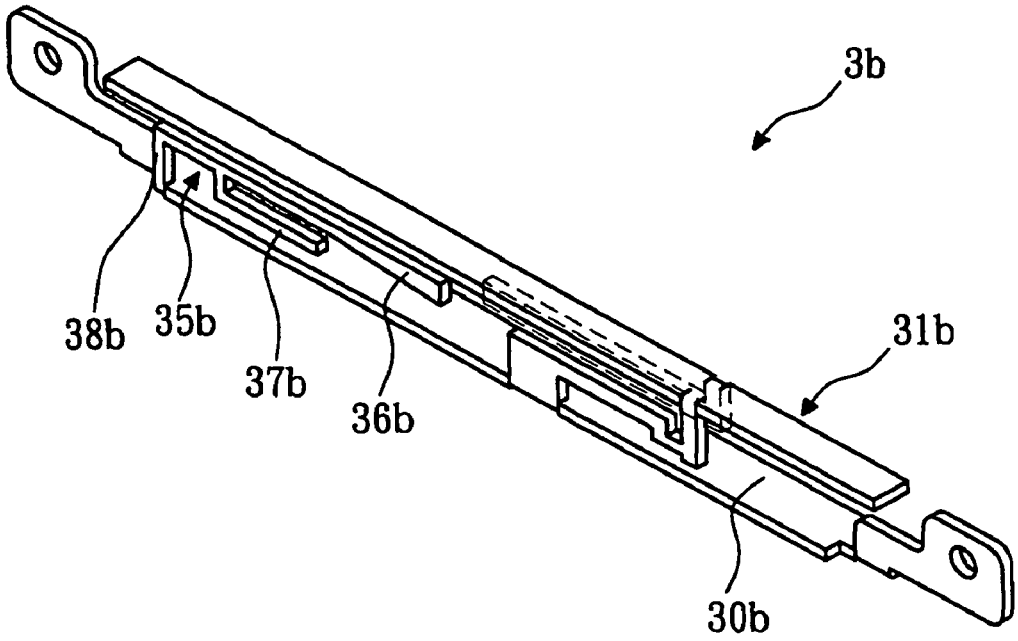
FIG. 7 is a stereogram view of the integrated antenna according to the third embodiment of the present invention.
Figure 8:
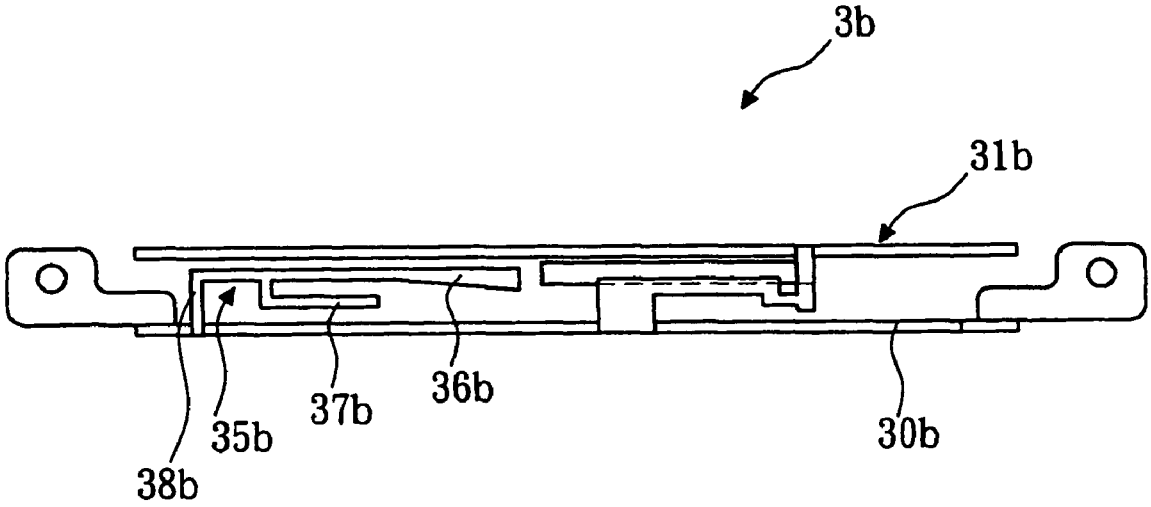
FIG. 8 is a front view of the integrated antenna according to the third embodiment of the present invention.

FIGS. 7 and 8 are schematic views of an integrated antenna 3*b* applied to WWAN and WLAN according to the third embodiment of the present invention. The integrated antenna 3*b* includes a ground metal plane 30*b*, a WWAN antenna 31*b*, and a WLAN antenna 35*b*. Unlike the integrated antenna 3 of the first embodiment, the WLAN antenna 35*b* of the third embodiment is not T-shaped. The second connecting metal strip 38*b* of the WLAN antenna 35*b* connects the third radiating metal strip 36*b* and the fourth radiating metal strip 37*b* to the ground metal plane 30*b*. The third radiating metal strip 36*b* and the fourth radiating metal strip 37*b* extend in the same direction. Thus, the WLAN antenna 35*b* assumes an F-shape. The integrated antenna 3*b* for WWAN and WLAN in the third embodiment of the present invention can only be used in WWAN by deleting the WLAN antenna 35*b*, thus becoming an antenna for WWAN.

Figure 9:
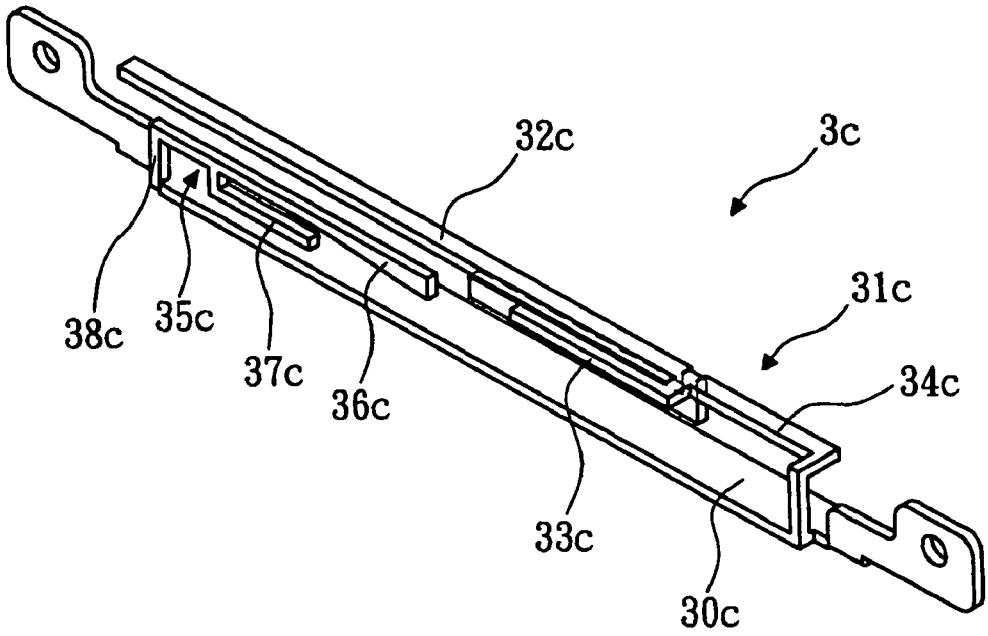
FIG. 9 is a stereogram view of the integrated antenna according to the fourth embodiment of the present invention.
Figure 10:
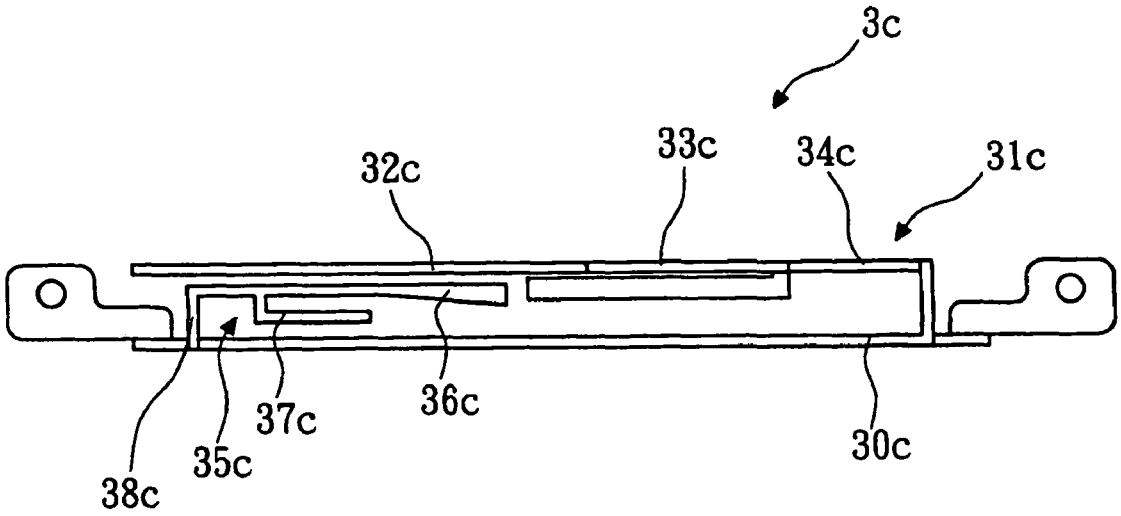
FIG. 10 is a front view of the integrated antenna according to the fourth embodiment of the present invention.

FIGS. 9 and 10 are schematic views of an integrated antenna 3*c* applied to WWAN and WLAN according to the fourth embodiment of the present invention. The integrated antenna 3*c* includes a ground metal plane 30*c*, a WWAN antenna 31*c*, and a WLAN antenna 35*c*. Unlike the integrated antenna 3 of the first embodiment, both the WWAN antenna 31*c* and the WLAN antenna 35*c* of the fourth embodiment assume an F-shape instead of a T-shape. The first radiating metal strip 32*c* and the second radiating metal strip 33*c* of the WWAN antenna 31*c* extend in the same direction. The third radiating metal strip 36*c* and the fourth radiating metal strip 37*c* of the WLAN antenna 35*c* extend in the same direction.

In the fourth embodiment, the first radiating metal strip 32*c* and the second radiating metal strip 33*c* of the WWAN antenna 31*c* extend toward the WLAN antenna 35*c*. In other applications, the WWAN antenna can extend in a direction opposite to the WLAN antenna. Moreover, in the fourth embodiment, the third radiating metal strip 36*c* and the fourth radiating metal strip 37*c* of the WLAN antenna 35*c* extend toward the WWAN antenna 31*c*. In other applications, the WLAN antenna may extend in a direction opposite the WWAN antenna. Similarly, in other embodiments mentioned above, the direction of the extension of F-shaped WWAN antenna or WLAN antenna is not limited to that in the figure and can be opposite that shown in the figure. The integrated antenna 3*c* for WWAN and WLAN in the fourth embodiment of the present invention can only be used in WWAN by deleting the WLAN antenna 35*c*, thus becoming an antenna for WWAN.

Referring to FIGS. 3 and 4 again, the first radiating metal strip 32 of the WWAN antenna 31 extends toward the WLAN antenna 35, and the second radiating metal strip 33 extends in the direction opposite the WLAN antenna 35. In other applications, the positions and directions of the extension of the first and second radiating metal strips can be interchanged. That is, the first radiating metal strip extends in the direction opposite the WLAN antenna, and the second radiating metal strip extends toward the WLAN antenna. Similarly, in other embodiments mentioned above, the direction of the extension of the T-shaped WWAN antenna or WLAN antenna is not limited to that in the figure, and can extend in the direction opposite to that as shown in the figure, and can extend in the direction opposite that shown in the figure.

In the integrated antenna 3, the ground metal plane 30 is disposed on a bottom surface. The first connecting metal strip 34 of the WWAN antenna 31 extends from one side of the ground metal plane 30 and is disposed on a first side surface. The first radiating metal strip 32 and the second radiating metal strip 33 of the WWAN antenna 31 are disposed on a top surface which is opposite the bottom surface. The WWAN antenna 31 further includes an extending metal strip 40 disposed on a second side surface which is opposite the first side surface. The WLAN antenna 35 is disposed on the first side surface, and the first connecting metal strip 34 is disposed on the same side surface. Therefore, the integrated antenna 3 is appreciably a cuboid with air as the medium.

Figure 11:
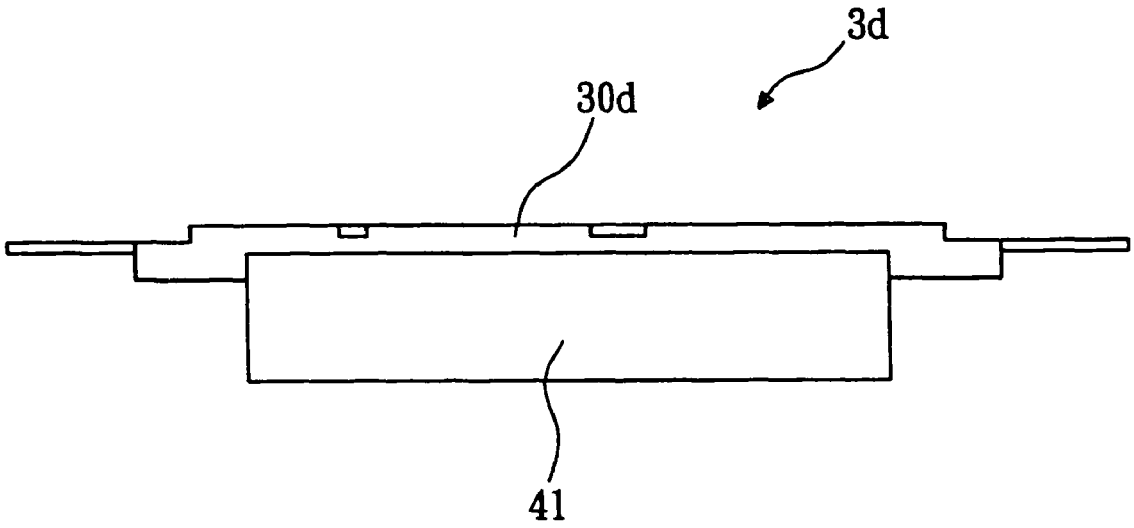
FIG. 11 is a stereogram view of the integrated antenna according to the fifth embodiment of the present invention.

FIG. 11 is a schematic view of an integrated antenna 3*d* applied to WWAN and WLAN according to the fifth embodiment of the present invention. The integrated antenna 3*d* further includes an auxiliary ground metal plane 41 connected to the ground metal plane 30*d* for providing an appropriate grounding. In the fifth embodiment, the auxiliary ground metal plane 41 is aluminum foil. In other applications, the auxiliary ground metal plane 41 can also be conductive foam. The integrated antenna 3*d* for WWAN and WLAN in the fifth embodiment of the present invention can only be used in WWAN by deleting the WLAN antenna, thus becoming an antenna for WWAN.

Figure 12:
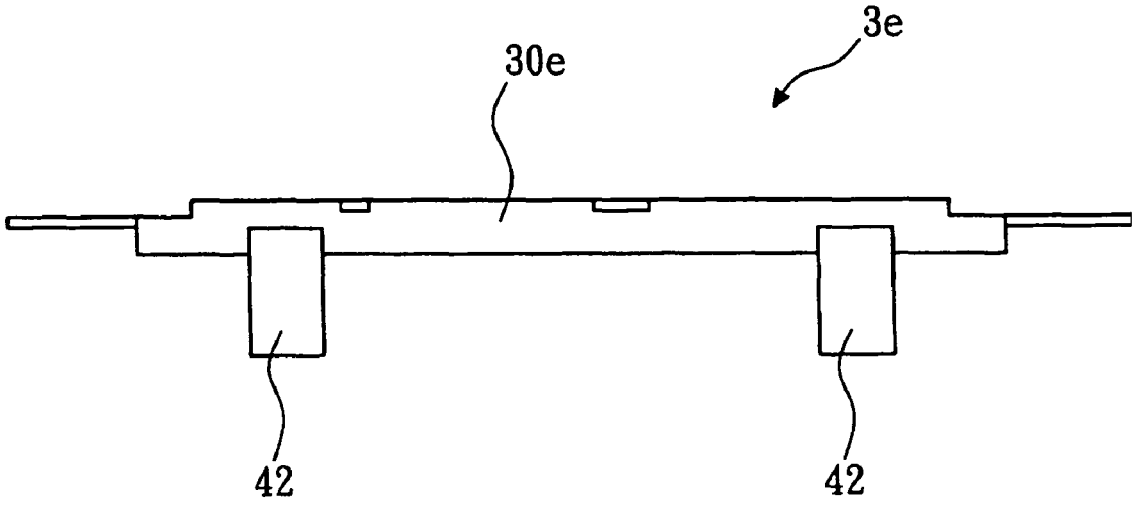
FIG. 12 is a schematic view of the integrated antenna according to the sixth embodiment of the present invention.

FIG. 12 is a schematic view of an integrated antenna 3*e* applied to WWAN and WLAN according to the sixth embodiment of the present invention. The integrated antenna 3*e* further includes a plurality of auxiliary ground metal planes 42 connected to the ground metal plane 30*e*, wherein the auxiliary ground metal planes 42 are spaced from one another. The aforementioned auxiliary ground metal plane 41 or 42 can be bent and folded, thus saving space to satisfy the requirements of customers and provide a preferred grounding effect and radiation effect. The integrated antenna 3*e* for WWAN and WLAN in the sixth embodiment of the present invention can only be used in WWAN by deleting the WLAN antenna, thus becoming an antenna for WWAN.

Figure 13:
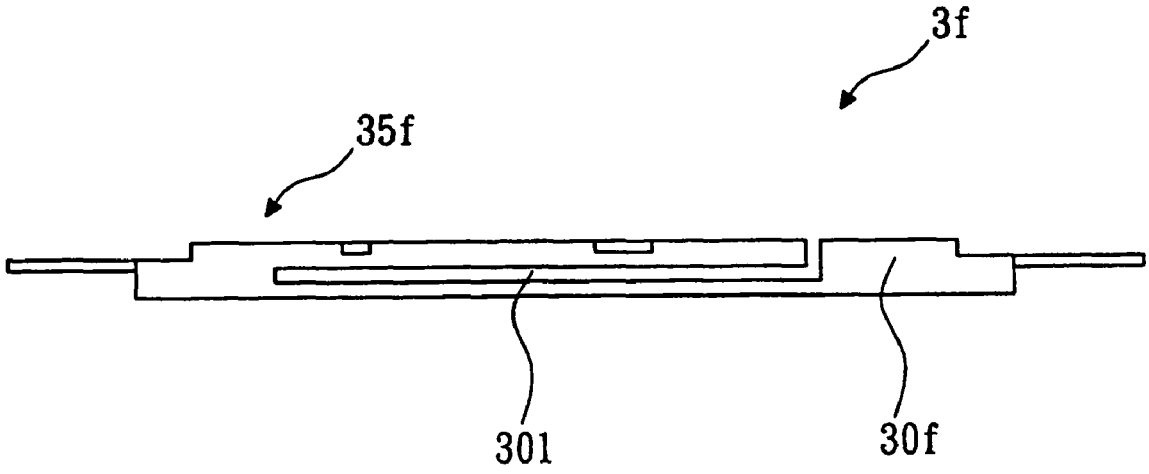
FIG. 13 is a schematic view of the integrated antenna according to the seventh embodiment of the present invention.

FIG. 13 is a schematic view of an integrated antenna 3*f* applied to WWAN and WLAN according to the seventh embodiment of the present invention. The ground metal plane 30*f* of the integrated antenna 3*f* is provided with a slotted hole 301, which extends downward from the ground metal plane 30*f* and then extends toward the WLAN antenna 35*f*. The slotted hole 301 can be used for adjusting the impedance matching and broadening the bandwidth. The integrated antenna 3*f* for WWAN and WLAN in the seventh embodiment of the present invention can only be used in WWAN by deleting the WLAN antenna 35*f*, thus becoming an antenna for WWAN.

The integrated antenna of the present invention can be applied to WWAN and WLAN at the same time. The size of the integrated antenna is within $100\times11\times5.8$ mm$^3$, and is small in volume and thus can be disposed in a wireless electronic device. Moreover, the ground metal plane of the integrated antenna can independently provide a grounding effect and can be selectively connected to a ground end of the wireless electronic device or not. Therefore, the integrated antenna can be mounted on any part of the wireless electronic device, and also have stable electrical characteristic.

Figure 14:
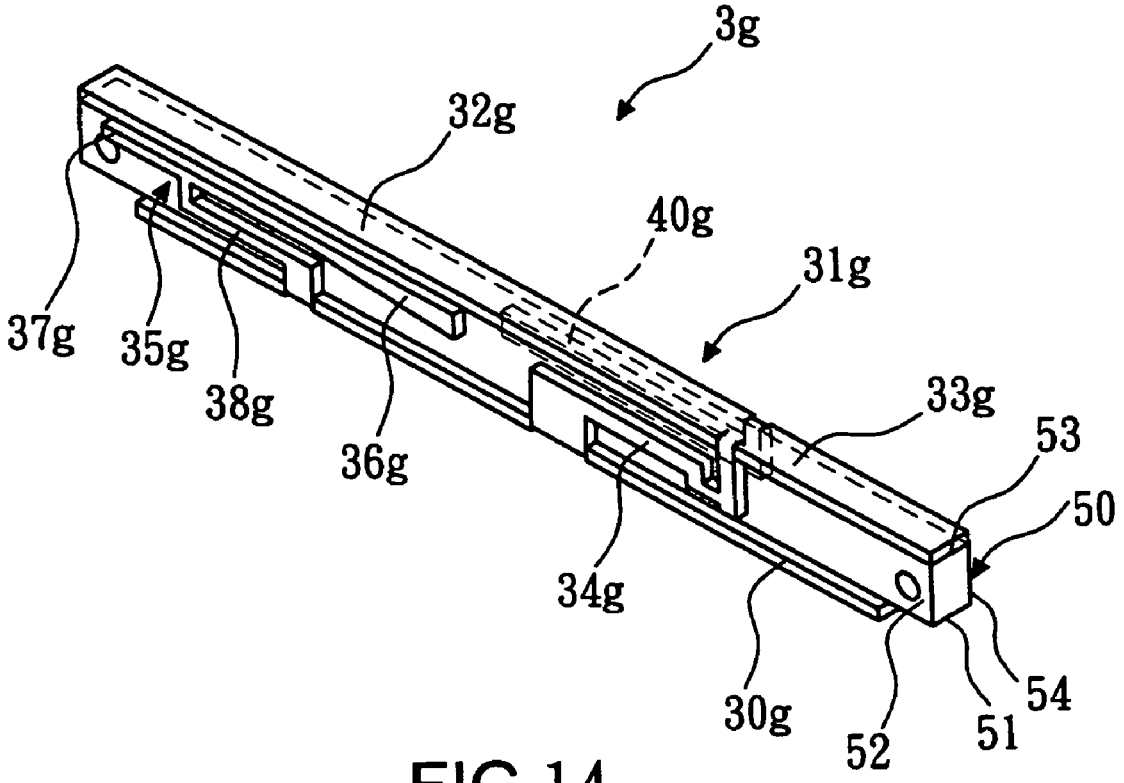
FIG. 14 is a stereogram view of the integrated antenna according to the eighth embodiment of the present invention.
Figure 15:
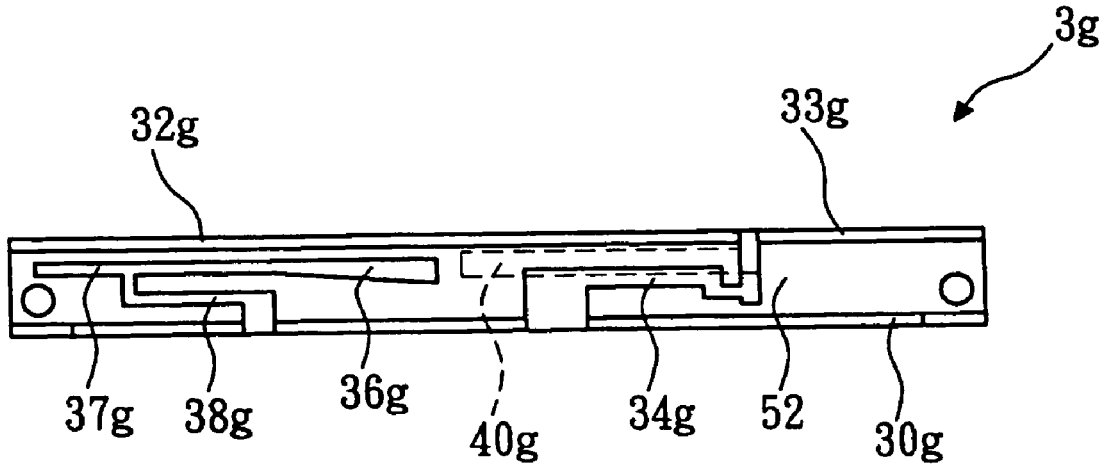
FIG. 15 is a front view of the integrated antenna according to the eighth embodiment of the present invention.

FIGS. 14 and 15 are schematic views of an integrated antenna 3*g* applied to WWAN and WLAN according to the eighth embodiment of the present invention. The integrated antenna 3*g* includes a ground metal plane 30*g*, a WWAN antenna 31*g*, a WLAN antenna 35*g*, and a substrate 50. The arrangement of the ground metal plane 30*g*, WWAN antenna 31*g*, and WLAN antenna 35*g* is identical to that of the ground metal plane 30, WWAN antenna 31, and WLAN antenna 35 of the first embodiment, and the details will not be described herein again.

The ground metal plane 30*g* is disposed on a bottom surface 51 of the substrate 50. The first connecting metal strip 34*g* of the WWAN antenna 31*g* extends from one side of the ground metal plane 30*g*, and is disposed on a first side surface 52 of the substrate 50. The first radiating metal strip 32*g* and the second radiating metal strip 33*g* of the WWAN antenna 31*g* are disposed on a top surface 53 of the substrate 50, in which the top surface is opposite the bottom surface 51. The extending metal strip 40*g* of the WWAN antenna 31*g* is disposed on a second side surface 54 of the substrate 50 in which the second side surface is opposite the first side surface 52. The WLAN antenna 35*g* is disposed on the first side surface 52 of the substrate 50. The substrate 50 can be a printed circuit board (PCB) or a ceramic substrate.

The integrated antenna 3*g* of the eighth embodiment of the present invention adopts the substrate 50 as the medium, which is different from the integrated antenna 3 in the first embodiment that uses air as the medium. Therefore, in the second, third, and fourth embodiments of the present invention, air is adopted as the medium, and in the eighth embodiment, a substrate is used as the medium. The integrated antenna 3*g* for WWAN and WLAN in the eighth embodiment of the present invention can only be used in WWAN by deleting the WLAN antenna 35*g*, thus becoming an antenna for WWAN.

Figure 16:
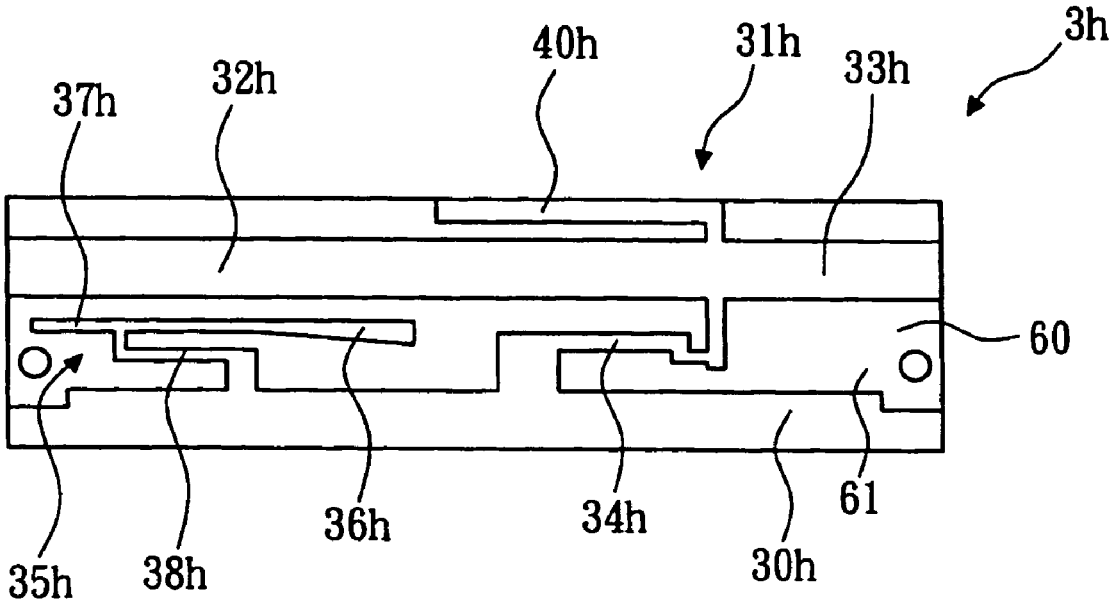
FIG. 16 is a top view of the integrated antenna according to the ninth embodiment of the present invention (before the FPCB is bent)

FIG. 16 is a schematic view of an integrated antenna 3*h* applied to WWAN and WLAN according to the ninth embodiment of the present invention. The integrated antenna 3*h* includes a ground metal plane 30*h*, a WWAN antenna 31*h*, a WLAN antenna 35*h*, and a flexible PCB (FPCB) 60. The WWAN antenna 31*h* is connected to the ground metal plane 30*h* and includes a first radiating metal strip 32*h* and a second radiating metal strip 33*h*. The WLAN antenna 35*h* is also connected to the ground metal plane 30*h*.

The ground metal plane 30*h*, WWAN antenna 31*h*, and WLAN antenna 35*h* are formed on a surface 61 of the FPCB 60. The ground metal plane 30*h* is disposed at the bottom of the surface 61 of the FPCB 60. The first connecting metal strip 34*h* of the WWAN antenna 31*h* extends upward from one side of the ground metal plane 30*h*. The first radiating metal strip 32*h* and the second radiating metal strip 33*h* of the WWAN antenna 31*h* extend upward from the first connecting metal strip 34*h*. The WWAN antenna 31*h* further includes an extending metal strip 40*h* extending from the junction of the first and second radiating metal strips 32*h*, 33*h*. The WLAN antenna 35*h* extends upward from the side of the ground metal plane 30*h*, and is disposed between the WWAN antenna 31*h* and the ground metal plane 30*h*.

Figure 17:
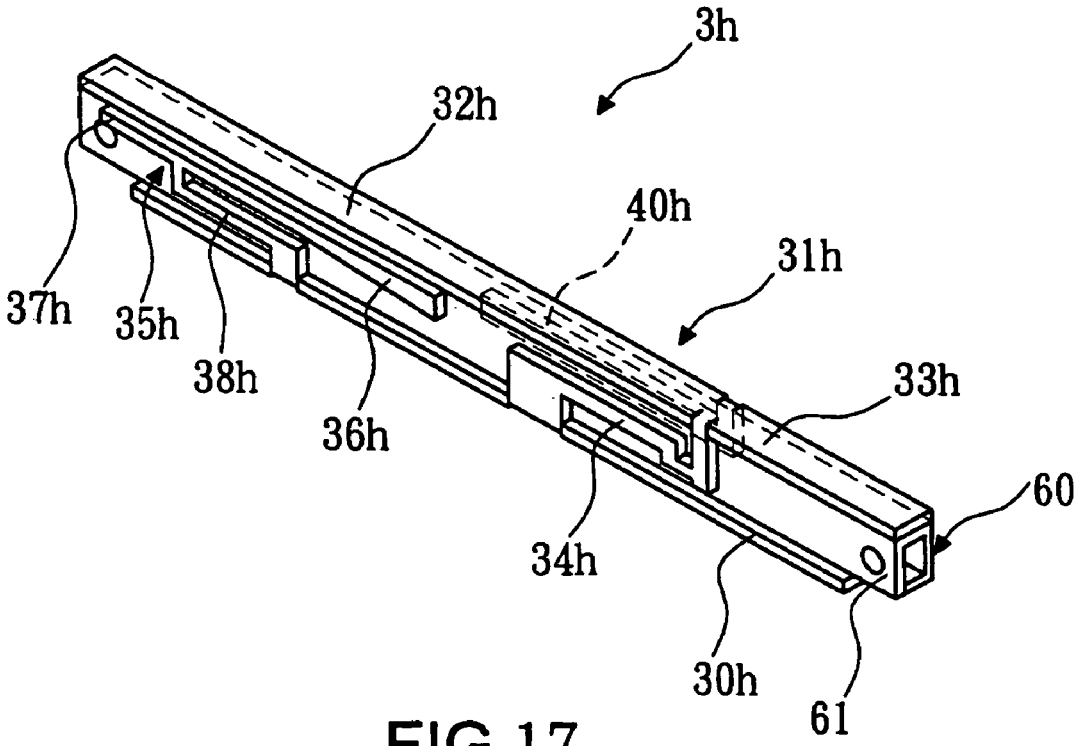
FIG. 17 is a stereogram view of the integrated antenna according to the ninth embodiment of the present invention (after the FPCB is bent)

Referring to FIG. 17, the FPCB 60 is bent into a cuboid, such that the ground metal plane 30*h* is disposed on a bottom surface of the cuboid. The first connecting metal strip 34*h* of the WWAN antenna 31*h* is disposed on a first side surface of the cuboid. The first radiating metal strip 32*h* and the second radiating metal strip 33*h* of the WWAN antenna 31*h* are disposed on a top surface of the cuboid, in which the top surface is opposite the bottom surface. The extending metal strip 40*h* of the WWAN antenna 31*h* is disposed on a second side surface of the cuboid, in which the second side surface is opposite the first side surface. The WLAN antenna 35*h* is disposed on the first side surface of the cuboid.

After the FPCB 60 is bent into a cuboid, the interior thereof still contains air. Thus, the integrated antenna 3*h* of the ninth embodiment of the present invention adopts the FPCB 60 and air as the medium, which is different from the integrated antenna 3 in the first embodiment that uses air as the medium. Moreover, in the second, third, and fourth embodiments of the present invention, air is adopted as the medium, and in the ninth embodiment, an FPCB and air is used as the medium.

The integrated antenna 3*h* of the ninth embodiment also has the functions of WWAN and WLAN. In addition, with its bendable characteristic, the FPCB 60 can be bent and folded into a predetermined shape, so as to be disposed in a wireless electronic device, and thereby the mounting of the antenna is more flexible. The integrated antenna 3*h* for WWAN and WLAN in the ninth embodiment of the present invention can only be used in WWAN by deleting the WLAN antenna 35*h*, thus becoming an antenna for WWAN.

Figure 19:
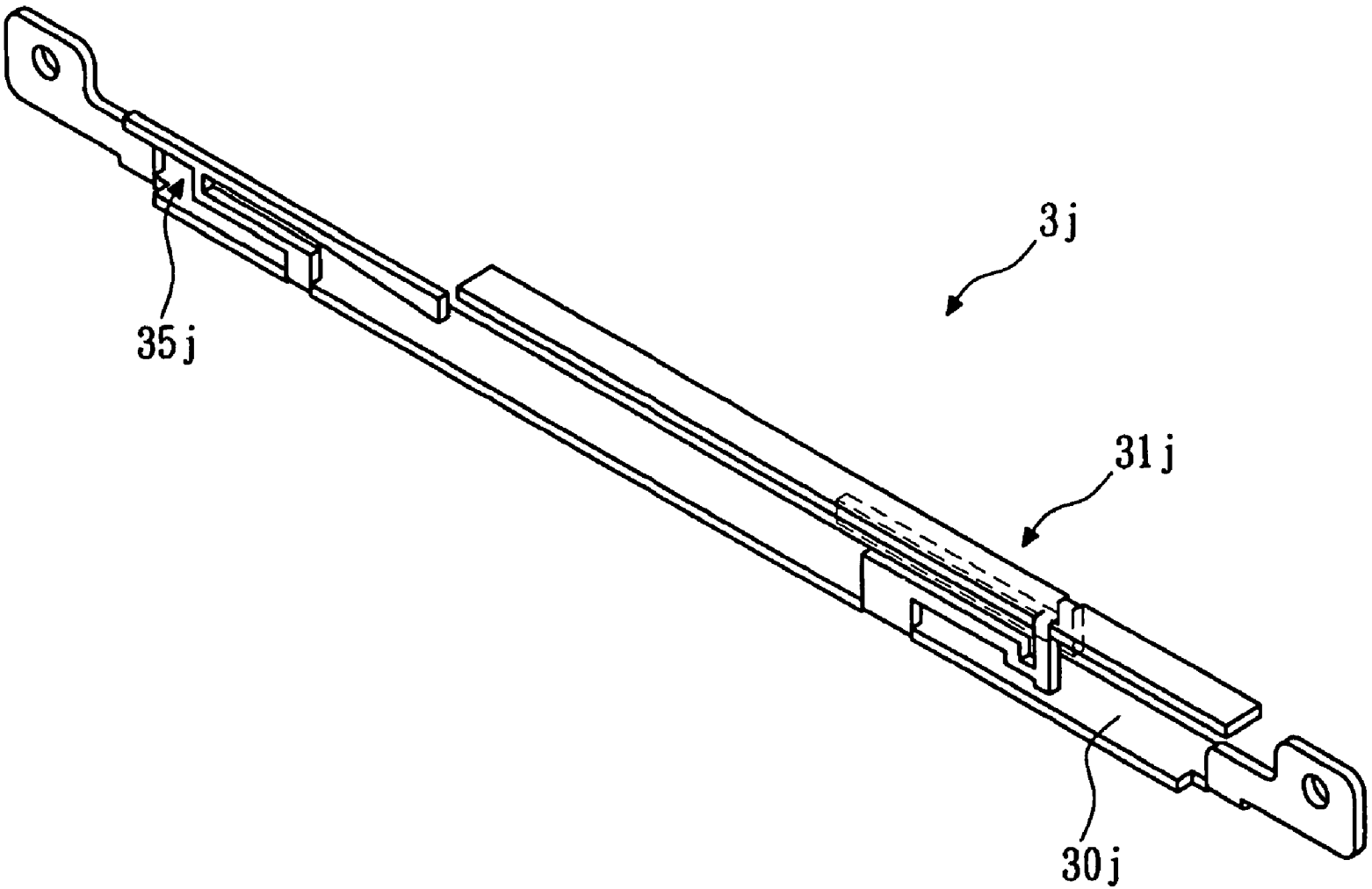
FIG. 19 is a stereogram view of the integrated antenna according to the tenth embodiment of the present invention.

FIG. 19 is a stereogram view of an integrated antenna 3*j* applied to WWAN and WLAN according to a tenth embodiment of the present invention. The integrated antenna 3*j* includes a ground metal plane 30*j*, a WWAN antenna 31*j*, and a WLAN antenna 35*j*. Unlike the integrated antenna 3 of the first embodiment, the WLAN antenna 35*j* and the WWAN antenna 31*j* are not overlapped in the space, the WLAN antenna 35*j* is mounted on the left side of the WWAN antenna 31*j*.

Figure 20:
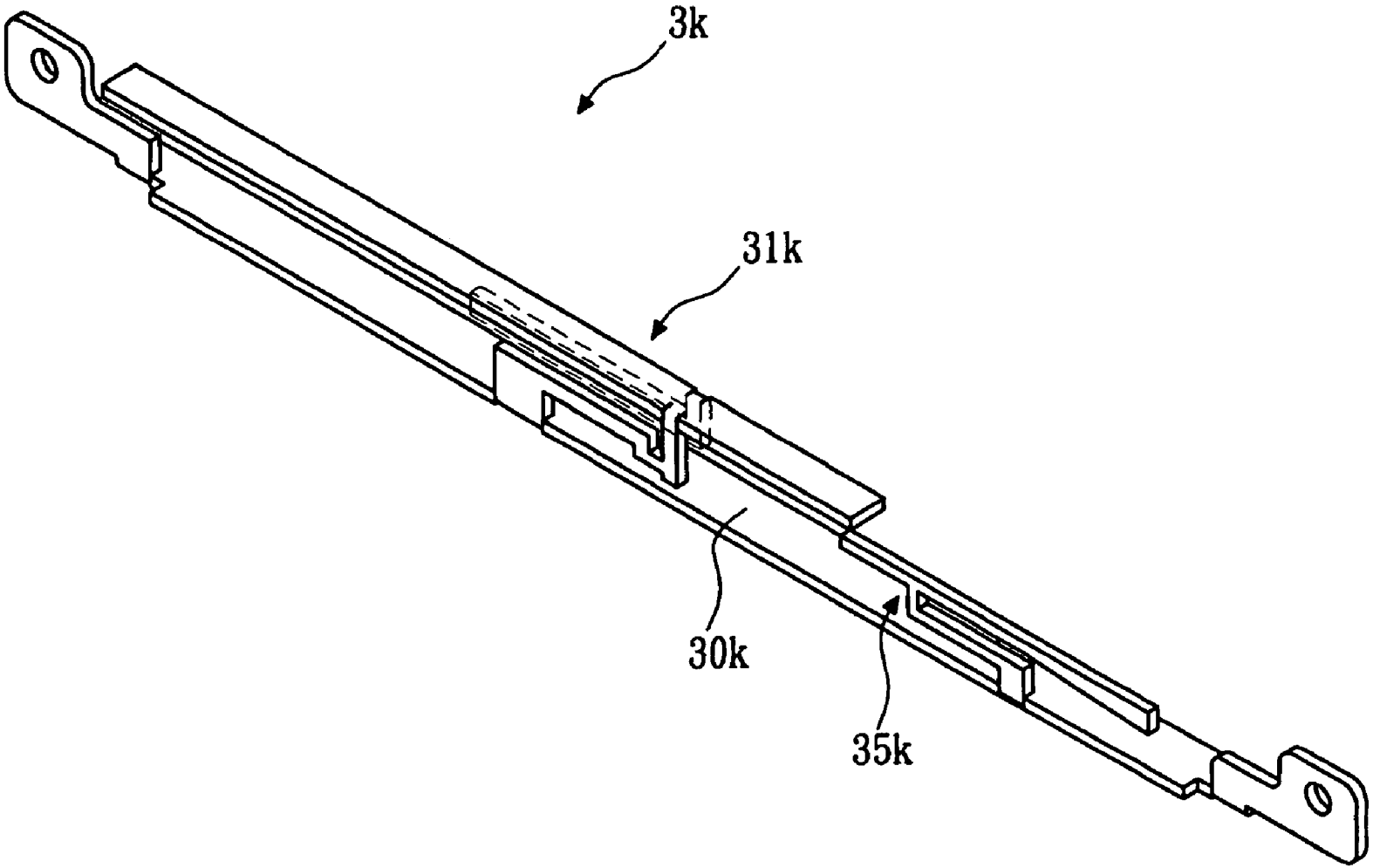
FIG. 20 is a stereogram view of the integrated antenna according to the eleventh embodiment of the present invention.

FIG. 20 is a stereogram view of an integrated antenna 3*k* applied to WWAN and WLAN according to a eleventh embodiment of the present invention. The integrated antenna 3*k* includes a ground metal plane 30*k*, a WWAN antenna 31*k*, and a WLAN antenna 35*k*. Unlike the integrated antenna 3 of the first embodiment, the WLAN antenna 35*k* and the WWAN antenna 31*k* are not overlapped in the space, the WLAN antenna 35*k* is mounted on the left side of the WWAN antenna 3*k*.

According to the above description on the tenth and eleventh embodiment, whatever the WWAN assumes a T-shape or F-shape, or the WLAN assumes a T-shape or F-shape, the WLAN antenna and the WWAN antenna may be not overlapped in the space, and the WLAN antenna can be mounted on the right side or the left side of the WWAN antenna.

Figure 21:
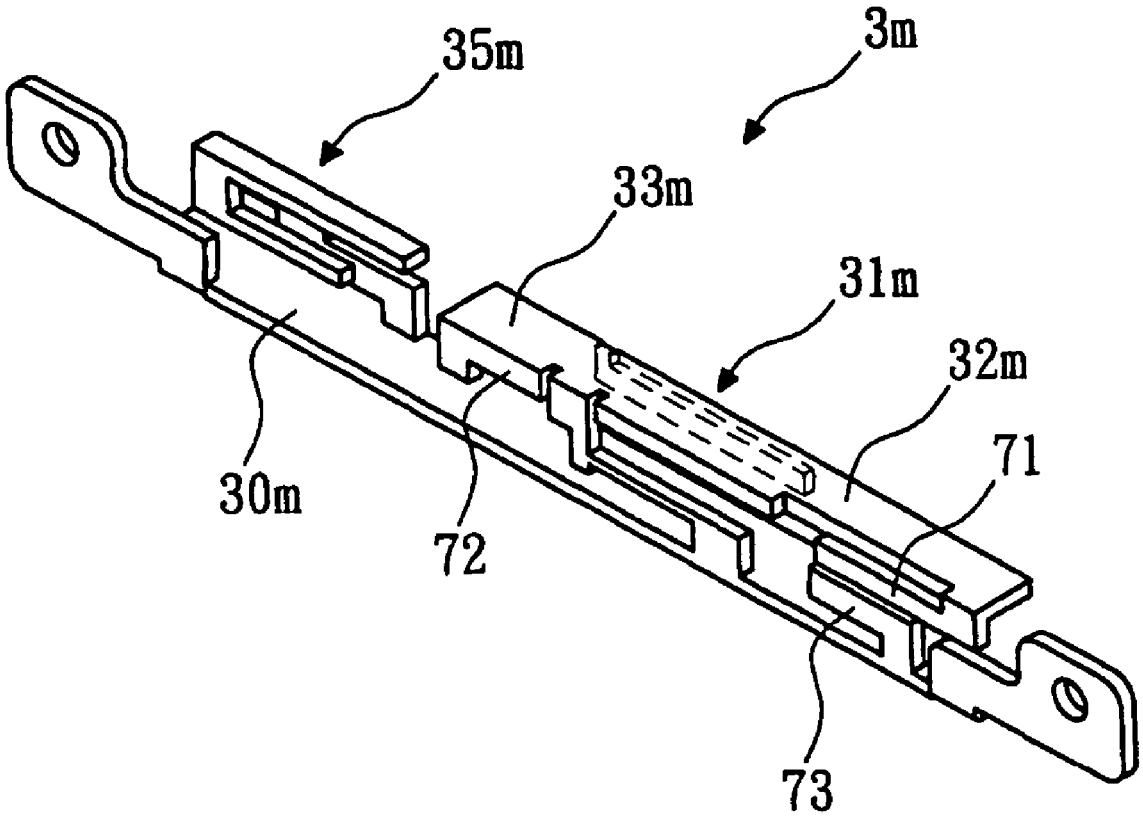
FIG. 21 is a stereogram view of the integrated antenna according to the twelfth embodiment of the present invention.

FIG. 21 is a stereogram view of the integrated antenna 3*m* applied to WWAN and WLAN according to the twelfth embodiment of the present invention. The integrated antenna 3*m* includes a ground metal plane 30*m*, a WWAN antenna 31*m*, and a WLAN antenna 35*m*. The WWAN antenna 31*m* is connected to the ground metal plane 30*m* and includes a first radiating metal strip 32*m* and a second radiating metal strip 33*m*. The first and second radiating metal strips 32*m*, 33*m* are used to induce a first resonance mode and a second resonance mode respectively. The first radiating metal strip 32*m* is longer than the second radiating metal strip 33*m*.

The first radiating metal strip 32*m* further comprises a first prolonging metal strip 71 for prolonging the length of the first radiating metal strip 32*m*. The first prolonging metal strip 71 is mounted on the first side surface of the integrated antenna 3*m*. The second radiating metal strip 33*m* further comprises a second prolonging metal strip 72 for prolonging the length of the second radiating metal strip 33*m*. The second prolonging metal strip 72 is mounted on the first side surface of the integrated antenna. The first prolonging metal strip and the second prolonging metal strip may be mounted on the second side of the integrated antenna.

In this embodiment, the WLAN antenna 35*m* is mounted on the second side surface of the integrated antenna 3*m*. Therefore, in the first embodiment to the eleventh embodiment, the WLAN antenna does not be limited to be mounted on the first side surface, and the WLAN antenna can be mounted on the second side surface of the integrated antenna.

The integrated antenna 3*m* further comprises a coupling metal strip 73. The coupling metal strip 73 is mounted on the first side surface at a corresponding position below the first radiating metal strip 32*m* (the first prolonging metal strip 71) for lowering the frequency of the first resonance mode. The coupling metal strip may be mounted on the first side surface at a corresponding position below the second radiating metal strip (the second prolonging metal strip). The coupling metal strip may be mounted on the a second side surface of the integrated antenna.

The integrated antenna 3*m* for WWAN and WLAN in the twelfth embodiment of the present invention can only be used in WWAN by deleting the WLAN antenna 35*m*, thus becoming an antenna for WWAN.

While several embodiments of the present invention have been illustrated and described, various modifications and improvements can be made by those skilled in the art. The embodiment of the present invention is therefore described in an illustrative, but not restrictive, sense. It is intended that the present invention may not be limited to the particular forms as illustrated, and that all modifications which maintain the spirit and scope of the present invention are within the scope as defined in the appended claims.

What is claimed is:

1. An integrated antenna for WWAN and WLAN, comprising:

a ground metal plane;

a WWAN antenna, connected to the ground metal plane and comprising a first radiating metal strip and a second radiating metal strip, wherein the first and second radiating metal strips are used to induce a first resonance mode and a second resonance mode respectively, the WWAN antenna further comprises a first connecting metal strip for connecting the first radiating metal strip and the second radiating metal strip to the ground metal plane; and a WLAN antenna, connected to the ground metal plane and comprising a third radiating metal strip and a fourth radiating metal strip, wherein the third and fourth radiating metal strips are used to induce a third resonance mode and a fourth resonance mode respectively, the WLAN antenna further comprises a second connecting metal strip for connecting the third radiating metal strip and the fourth radiating metal strip to the ground metal plane, wherein the ground metal plane is disposed on a bottom surface, the first connecting metal strip of the WWAN antenna extends from one side of the ground metal plane and is disposed on a first side surface, the first radiating metal strip and the second radiating metal strip of the WWAN antenna are disposed on a top surface which is opposite the bottom surface, and the WWAN antenna further comprises an extending metal strip disposed on a second side surface which is opposite the first side surface; the WLAN antenna is disposed on the first side surface or the second side surface.

2. The integrated antenna as claimed in claim 1, wherein the frequency of the first resonance mode is 850 MHz and 900 MHz, the frequency of the second resonance mode is 1575 MHz, 1800 MHz and 1900 MHz, or 1800 MHz, 1900 MHz and 2000 MHz, the frequency of the third resonance mode is 2.4 GHz, and the frequency of the fourth resonance mode is 5 GHz.

3. The integrated antenna as claimed in claim 1, wherein the first radiating metal strip and the second radiating metal strip extend in two opposite directions, so that the WWAN antenna assumes a T-shape; the third radiating metal strip and the fourth radiating metal strip extend in two opposite directions, so that the WLAN antenna assumes a T-shape.

4. The integrated antenna as claimed in claim 1, wherein the first radiating metal strip and the second radiating metal strip extend in the same direction, so that the WWAN antenna assumes an F-shape; the third radiating metal strip and the fourth radiating metal strip extend in two opposite directions, so that the WLAN antenna assumes a T-shape.

5. The integrated antenna as claimed in claim 1, wherein the first radiating metal strip and the second radiating metal strip extend in two opposite directions, so that the WWAN antenna assumes a T-shape; the third radiating metal strip and the fourth radiating metal strip extend in the same direction, so that the WLAN antenna assumes an F-shape.

6. The integrated antenna as claimed in claim 1, wherein the first radiating metal strip and the second radiating metal strip extend in the same direction, so that the WWAN antenna assumes an F-shape; the third radiating metal strip and the fourth radiating metal strip extend in the same direction, so that the WLAN antenna assumes an F-shape.

7. The integrated antenna as claimed in claim 1, further comprising at least one auxiliary ground metal plane connected to the ground metal plane for providing an appropriate grounding.

8. The integrated antenna as claimed in claim 7, wherein the auxiliary ground metal plane is aluminum foil.

9. The integrated antenna as claimed in claim 7, wherein the auxiliary ground metal plane is conductive foam.

10. The integrated antenna as claimed in claim 1, wherein the ground metal plane has at least one slotted hole.

11. The integrated antenna as claimed in claim 1, wherein the first radiating metal strip further comprises a first prolonging metal strip for prolonging the length of the first radiating metal strip.

12. The integrated antenna as claimed in claim 11, wherein the first prolonging metal strip is mounted on a first side surface or a second side surface of the integrated antenna.

13. The integrated antenna as claimed in claim 1, wherein the second radiating metal strip further comprises a second prolonging metal strip for prolonging the length of the second radiating metal strip.

14. The integrated antenna as claimed in claim 13, wherein the second prolonging metal strip is mounted on a first side surface or a second side surface of the integrated antenna.

15. The integrated antenna as claimed in claim 1, wherein the integrated antenna further comprises a coupling metal strip.

16. The integrated antenna as claimed in claim 15, wherein the coupling metal strip is mounted on a first side surface or a second side surface of the integrated antenna.

17. The integrated antenna as claimed in claim 15, wherein the coupling metal strip is mounted on the first side surface at a corresponding position below the first radiating metal strip.

18. The integrated antenna as claimed in claim 15, wherein the coupling metal strip is mounted on the first side surface at a corresponding position below the second radiating metal strip.

19. The integrated antenna as claimed in claim 1, wherein the WLAN antenna and the WWAN antenna are not overlapped in the space.

20. The integrated antenna as claimed in claim 19, wherein the WLAN antenna is mounted on the right side or the left side of the WWAN antenna.

21. The integrated antenna as claimed in claim 1, wherein the first radiating metal strip and the second radiating metal strip extend in the same direction, so that the WWAN antenna assumes an F-shape.

22. An integrated antenna for WWAN and WLAN, comprising:

a ground metal plane;

a WWAN antenna, connected to the around metal plane and comprising a first radiating metal strip and a second radiating metal strip, wherein the first and second radiating metal strips are used to induce a first resonance mode and a second resonance mode respectively, the WWAN antenna further comprises a first connecting metal strip for connecting the first radiating metal strip and the second radiating metal strip to the ground metal plane; and a WLAN antenna, connected to the ground metal plane and comprising a third radiating metal strip and a fourth radiating metal strip, wherein the third and fourth radiating metal strips are used to induce a third resonance mode and a fourth resonance mode respectively, the WLAN antenna further comprises a second connecting metal strip for connecting the third radiating metal strip and the fourth radiating metal strip to the ground metal plane, wherein the integrated antenna further comprises a printed circuit board (PCB), the ground metal plane is disposed on a bottom surface of the PCB, the first connecting metal strip of the WWAN antenna extends from one side of the ground metal plane and is disposed on a first side surface of the PCB, the first radiating metal strip and the second radiating metal strip of the WWAN antenna are disposed on a top surface of the PCB in which the top surface is opposite the bottom surface, and the WWAN antenna further comprises an extending metal strip disposed on a second side surface of the PCB in which the second side surface is opposite the first side surface; the WLAN antenna is disposed on the first side surface or the second side surface of the PCB.

23. An integrated antenna for WWAN and WLAN, comprising:

a ground metal plane;

a WWAN antenna, connected to the ground metal plane and comprising a first radiating metal strip and a second radiating metal strip wherein the first and second radiating metal strips are used to induce a first resonance mode and a second resonance mode respectively, the WWAN antenna further comprises a first connecting metal strip for connecting the first radiating metal strip and the second radiating metal strip to the ground metal plane; and a WLAN antenna, connected to the ground metal plane and comprising a third radiating metal strip and a fourth radiating metal strip, wherein the third and fourth radiating metal strips are used to induce a third resonance mode and a fourth resonance mode respectively, the WLAN antenna further comprises a second connecting metal strip for connecting the third radiating metal strip and the fourth radiating metal strip to the ground metal plane, wherein the integrated antenna further comprises a ceramic substrate, the ground metal plane is disposed on a bottom surface of the ceramic substrate, the first connecting metal strip of the WWAN antenna extends from one side of the ground metal plane and is disposed on a first side surface of the ceramic substrate, the first radiating metal strip and the second radiating metal strip of the WWAN antenna are disposed on a top surface of the ceramic substrate in which the top surface is opposite the bottom surface, and the WWAN antenna further comprises an extending metal strip disposed on a second side surface of the ceramic substrate in which the second side surface is opposite the first side surface; the WLAN antenna is disposed on the first side surface or the second side surface of the ceramic substrate.

24. An integrated antenna for WWAN and WLAN, comprising:

a ground metal plane;

a WWAN antenna, connected to the ground metal plane and comprising a first radiating metal strip and a second radiating metal strip, wherein the first and second radiating metal strips are used to induce a first resonance mode and a second resonance mode respectively, the WWAN antenna further comprises a first connecting metal strip for connecting the first radiating metal strip and the second radiating metal strip to the ground metal plane; and a WLAN antenna, connected to the around metal plane and comprising a third radiating metal strip and a fourth radiating metal strip, wherein the third and fourth radiating metal strips are used to induce a third resonance mode and a fourth resonance mode respectively, the WLAN antenna further comprises a second connecting metal strip for connecting the third radiating metal strip and the fourth radiating metal strip to the ground metal plane, wherein the integrated antenna further comprises a flexible PCB (FPCB), the ground metal plane is disposed at a bottom surface of the FPCB, the first connecting metal strip of the WWAN antenna extends upward from one side of the ground metal plane, the first radiating metal strip and the second radiating metal strip of the WWAN antenna extend upward from the first connecting metal strip, and the WWAN antenna further comprises an extending metal strip extending from the junction of the first and second radiating metal strips; the WLAN antenna extends upward from the side of the ground metal plane and is disposed between the WWAN antenna and the ground metal plane.

25. The integrated antenna as claimed in claim 24, wherein the FPCB is bent into a cuboid, the ground metal plane is disposed on a bottom surface of the cuboid, the first connecting metal strip of the WWAN antenna is disposed on a first side surface of the cuboid, the first radiating metal strip and the second radiating metal strip of the WWAN antenna are disposed on a top surface of the cuboid in which the top surface is opposite the bottom surface, and the extending metal strip of the WWAN antenna is disposed on a second side surface of the cuboid in which the second side surface is opposite the first side surface; the WLAN antenna is disposed on the first side surface of the cuboid.

26. An antenna for WWAN, comprising:

a ground metal plane; and a WWAN antenna, connected to the ground metal plane and comprising a first radiating metal strip, a second radiating metal strip and a first connecting metal strip, wherein the first and second radiating metal strips are used to induce a first resonance mode and a second resonance mode respectively, and the first connecting metal strip is used for connecting the first radiating metal strip and the second radiating metal strip to the ground metal plane, wherein the ground metal plane is disposed on a bottom surface, the first connecting metal strip of the WWAN antenna extends from one side of the ground metal plane and is disposed on a first side surface, the first radiating metal strip and the second radiating metal strip of the WWAN antenna are disposed on a top surface which is opposite the bottom surface, and the WWAN antenna further comprises an extending metal strip disposed on a second side surface which is opposite the first side surface.

27. The antenna as claimed in claim 26, wherein the frequency of the first resonance mode is 850 MHz and 900 MHz, the frequency of the second resonance mode is 1575 MHz, 1800 MHz and 1900 MHz, or 1800 MHz, 1900 MHz and 2000 MHz.

28. The antenna as claimed in claim 26, wherein the first radiating metal strip and the second radiating metal strip extend in two opposite directions, so that the WWAN antenna assumes a T-shape.

29. An antenna for WWAN, comprising:

a ground metal plane; and a WWAN antenna, connected to the ground metal plane and comprising a first radiating metal strip, a second radiating metal strip and a first connecting metal strip, wherein the first and second radiating metal strips are used to induce a first resonance mode and a second resonance mode respectively, and the first connecting metal strip is used for connecting the first radiating metal strip and the second radiating metal strip to the ground metal plane, wherein the integrated antenna further comprises a printed circuit board (PCB), the ground metal plane is disposed on a bottom surface of the PCB, the first connecting metal strip of the WWAN antenna extends from one side of the ground metal plane and is disposed on a first side surface of the PCB, the first radiating metal strip and the second radiating metal strip of the WWAN antenna are disposed on a top surface of the PCB in which the top surface is opposite the bottom surface, and the WWAN antenna further comprises an extending metal strip disposed on a second side surface of the PCB in which the second side surface is opposite the first side surface.

30. An antenna for WWAN, comprising:

a ground metal plane; and a WWAN antenna, connected to the ground metal plane and comprising a first radiating metal strip, a second radiating metal strip and a first connecting metal strip, wherein the first and second radiating metal strips are used to induce a first resonance mode and a second resonance mode respectively, and the first connecting metal strip is used for connecting the first radiating metal strip and the second radiating metal strip to the ground metal plane, wherein the integrated antenna further comprises a ceramic substrate, the ground metal plane is disposed on a bottom surface of the ceramic substrate, the first connecting metal strip of the WWAN antenna extends from one side of the ground metal plane and is disposed on a first side surface of the ceramic substrate, the first radiating metal strip and the second radiating metal strip of the WWAN antenna are disposed on a top surface of the ceramic substrate in which the top surface is opposite the bottom surface, and the WWAN antenna further comprises an extending metal strip disposed on a second side surface of the ceramic substrate in which the second side surface is opposite the first side surface.

31. An antenna for WWAN, comprising:

a ground metal plane; and a WWAN antenna, connected to the ground metal plane and comprising a first radiating metal strip, a second radiating metal strip and a first connecting metal strip, wherein the first and second radiating metal strips are used to induce a first resonance mode and a second resonance mode respectively, and the first connecting metal strip is used for connecting the first radiating metal strip and the second radiating metal strip to the ground metal plane, wherein the integrated antenna further comprises a flexible PCB (FPCB), the ground metal plane is disposed at a bottom surface of the FPCB, the first connecting metal strip of the WWAN antenna extends upward from one side of the ground metal plane, the first radiating metal strip and the second radiating metal strip of the WWAN antenna extend upward from the first connecting metal strip, and the WWAN antenna further comprises an extending metal strip extending from the junction of the first and second radiating metal strips.

32. The antenna as claimed in claim 31, wherein the FPCB is bent into a cuboid, the ground metal plane is disposed on a bottom surface of the cuboid, the first connecting metal strip of the WWAN antenna is disposed on a first side surface of the cuboid, the first radiating metal strip and the second radiating metal strip of the WWAN antenna are disposed on a top surface of the cuboid in which the top surface is opposite the bottom surface, and the extending metal strip of the WWAN antenna is disposed on a second side surface of the cuboid in which the second side surface is opposite the first side surface.

* * * * *